US006640477B1

(12) United States Patent
Timpson et al.

(10) Patent No.: US 6,640,477 B1
(45) Date of Patent: Nov. 4, 2003

(54) MULTIPLE USE AUTOMOBILE BANNER

(76) Inventors: Julienne R. Timpson, 7032 S. 2400 West, West Jordan, UT (US) 84084; R. Brent Timpson, 7032 S. 2400 West, West Jordan, UT (US) 84084

( * ) Notice: Subject to any disclaimer, the term of this patent is extended or adjusted under 35 U.S.C. 154(b) by 0 days.

(21) Appl. No.: 09/686,843

(22) Filed: Oct. 10, 2000

(51) Int. Cl.[7] ..... G09F 21/04; G09F 7/12
(52) U.S. Cl. ..... 40/591; 40/594
(58) Field of Search ..... 40/591, 593, 594, 40/644; D20/10, 19

(56) References Cited

U.S. PATENT DOCUMENTS

| | | | | | |
|---|---|---|---|---|---|
| 2,586,039 | A | | 2/1952 | Heggedal | |
| 4,059,912 | A | | 11/1977 | Noah | |
| 4,528,232 | A | * | 7/1985 | Cliffe | 40/593 X |
| 4,671,003 | A | * | 6/1987 | Vitol | 40/638 |
| 4,671,033 | A | | 6/1987 | Smith | |
| 4,864,755 | A | * | 9/1989 | Owens | 40/594 |
| 4,940,258 | A | * | 7/1990 | Cuba, Jr. et al. | 283/81 |
| 5,102,171 | A | | 4/1992 | Saetre | |
| 5,248,536 | A | | 9/1993 | Du Katz | |
| 5,252,071 | A | | 10/1993 | Hansard | |
| 5,258,214 | A | * | 11/1993 | Cooledge et al. | 428/43 |
| 5,290,067 | A | | 3/1994 | Langen | |
| 5,318,325 | A | | 6/1994 | Ipsen | |
| 5,334,431 | A | | 8/1994 | Longtin | |
| 5,403,025 | A | * | 4/1995 | Shanley | 283/81 |
| 5,466,502 | A | * | 11/1995 | Wilkinson et al. | 428/40 |
| 5,525,177 | A | * | 6/1996 | Ross | 156/240 |
| 5,628,858 | A | | 5/1997 | Petrou | |
| 5,899,010 | A | | 5/1999 | Peck | |
| 6,308,445 | B1 | * | 10/2001 | Porraro | 40/594 |

OTHER PUBLICATIONS

Declaration of Julienne R. Timpson and R. Brent Timpson regarding Non–Documentary Potential Prior Art.

* cited by examiner

*Primary Examiner*—Brian K. Green
(74) *Attorney, Agent, or Firm*—Clayton, Howarth & Cannon, P.C.

(57) ABSTRACT

A repositional and reusable automobile advertising banner, for attachment at the top exterior surface of the automobile windshield. The banner contains disclosure information to facilitate the sale of the car, including areas for entry of additional and varying information. When installed, the banner allows an unencumbered view of the entire width of the windshield, allowing the car to be test-driven without removal of the banner. Methods for use of the banner are also disclosed.

6 Claims, 3 Drawing Sheets

MULTIPLE USE AUTOMOBILE BANNER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. The Field of the Invention

The present invention relates generally to advertising and informational devices, and more particularly, but not entirely, to a repositional and reusable advertising banner for conveying information on automobiles.

2. Description of Related Art

It is common practice to provide information about an automobile that is offered for sale, by placing the information on a window of the automobile. An automobile dealer is required to inform a potential purchaser of an automobile of certain information about the automobile by state and federal laws. Similarly, the arrangements between an automobile dealer and the manufacturer may require other information to be disclosed. Further, potential purchasers often wish to be informed of other information concerning the automobile, prior to talking to a salesman.

Attempts have been made in the prior art to provide these types of information to potential purchasers, by placing the information on the automobile windows. An example of such an attempt is the use of paint to place the asking price on the windshield of the car. Another is the use of a plurality of individual cards or stickers, each bearing a single character, to place the price of the car, or other information, on a car window. Disadvantageously, these methods do not allow for the information to be repositioned on the windows, and may block the view of one driving the car, requiring the tedious practice of removing and replacing the information after each test drive of the automobile. Further, the cards or stickers are in some cases discarded after each use, increasing the expense of conveying the information. The size limitations also reduce the amount of information that can be conveyed.

There are several other devices for conveying required information known in the prior art, such as that disclosed in U.S. Pat. No. 5,290,067 to Langen (issued Mar. 1, 1994), which discloses a repositional window pricing label. The Langen device is a window pricing label, the label contains fixed indicia, and is then printed with information, strips of repositional adhesive are placed on the face of the sticker. The Langen sticker is then placed on a window of the automobile and may be repositioned. Once the auto is sold the adhesive strips are removed, and the sticker is retained by the purchaser as a receipt. While the Langen device allows more information to be conveyed, and enables repositioning, it is of a limited size, cannot be reused, and the information on the label once printed cannot be changed.

Other window stickers have been used with automobiles to convey information, such as those disclosed in U.S. Pat. No. 4,059,912 to Noah (issued Nov. 29, 1977) and U.S. Pat. No. 4,671,003 to Vitol (issued Jun. 9, 1987). These stickers are typically used to convey non-sales information, such as a parking permit or fleet number, are small in size, and the information on them cannot be changed.

Another window sticker used with automobiles has taken the form of a banner applied at the top of the automobile windshield. These banners do not block the view of a driver and so allow the car to be driven, but they convey limited information, do not allow for the information on them to be changed and cannot be reused.

It is noteworthy that none of the prior art known to applicant provides simultaneously a large advertising banner, that is capable of conveying a large amount of information, that can be repositioned and reused, that allows for the information to be altered, and allows a potential purchaser to operate the automobile while the banner is in place.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is therefore an object of the present invention to provide a readily noticeable advertising banner, that does not block the view of the automobile driver when the banner is in use.

It is another object of the present invention to provide such an advertising banner that is repositional.

It is a further object of the present invention, in accordance with one aspect thereof, to an advertising banner that is both repositional and reusable.

It is an additional object of the present invention, in accordance with one aspect thereof to provide an advertising banner that may be reused, and that allows for at least part of the information on the banner to be changed.

The above objects and others not specifically recited are realized in a specific illustrative embodiment of a multiple use automobile banner. The automobile banner is repositional and reusable, is configured to be placed at the top of the exterior surface of an automobile windshield and allows for at least some of the information on the banner to be altered.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
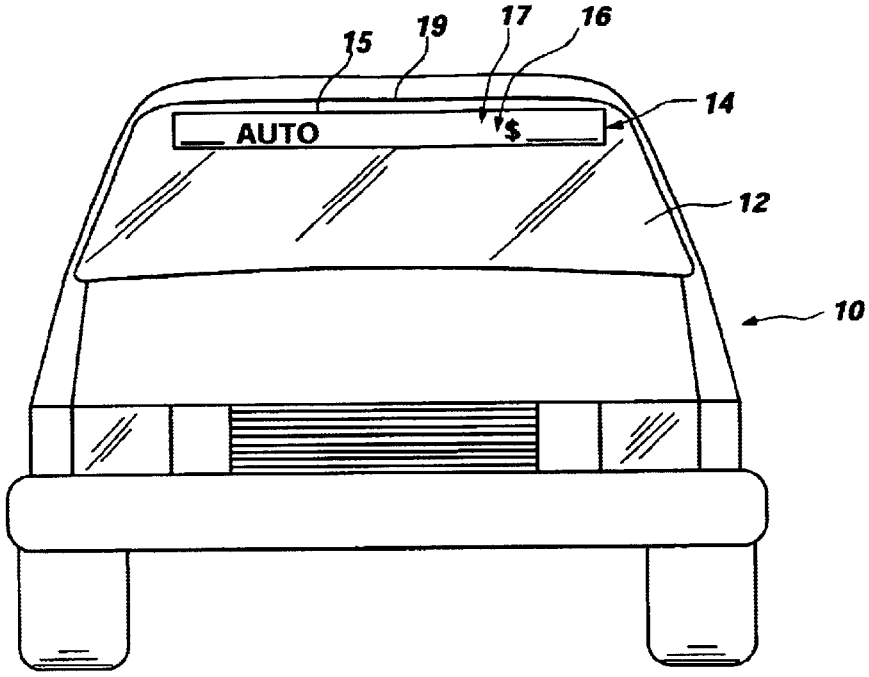
FIG. 1 is a front view of an automobile banner made in accordance with the principles of the present invention installed on an automobile windshield.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Applicant has conceived of an automobile banner that may be used to convey disclosure information, and additional information to a potential purchaser of an automobile, and which can be placed on the windshield while allowing a unrestricted view through the entire width of the automobile windshield. The banner is releasably attached to the exterior of the windshield, preferably at the top surface, and is preferably both repositional and reusable. A preferred design concept includes a reusable automobile banner made from a flexible material that is releasably attached to the top of an automobile windshield, the banner includes both disclosure information and areas to place additional information.

Referring now to FIG. 1, one possible embodiment of an automobile banner 14 in accordance with the principles of the present invention is shown installed upon an automobile windshield 12. As can be seen the banner 14 is installed in a lateral position, and covers at least a majority length of the width of the windshield 12. Automobile windshields on passenger vehicles typically range in size from about 42 inches to about 62 inches wide, and from about 13.5 inches to about 28 inches in height. Accordingly a preferred lateral length for the banner 14 is in the range of comprising from about 24 to about 60 inches. A more preferred length is in the range comprising from about 30 to about 50 inches. A most preferred length is in the range comprising from about 36 to about 54 inches. In order to allow a driver of an automobile, upon which the banner 14 has been installed, a full view across the width of the windshield 12, a preferred vertical length for the banner is in the range of about 2 to about 12 inches. More preferably the banner has a vertical length in the range comprising from about 3 to about 8 inches, most preferably the banner has a vertical length in the range comprising from about 4 to about 6 inches.

While the preferred shape of the banner is a large rectangle, it will be appreciated that many other shapes can be used and that all such shapes fall within the scope of the present invention.

Preferably, the banner 14 is installed at an upper position of the windshield 12. A preferred position for the installation of the banner 14 is such that a midpoint of the top edge 15 resides in a range between about 0.5 inches to about 5 inches below the top edge 19 of the automobile windshield 12. A more preferred position is with the midpoint of the top edge 15 residing a distance of about 1 inch to about 2.5 inches below the top edge 19 of the automobile windshield 12.

The banner 14 is attached to the windshield 12 by the use of a means for attachment. In the FIG. 1 embodiment, the means for attachment is associated with the rear surface 18 (not shown in FIG. 1) of the banner 14. The attachment means can be any suitable method, structure, or compound that may be used to releasably and repositionally attach the banner 14 to the windshield. Examples of such means include repositional adhesives, the application of pressure to the banner which causes an adhesive interaction between the banner and the windshield, or a static cling attraction between the glass surface of the windshield, and the rear surface 18, among other suitable means, all as known to those of ordinary skill in the art.

It will be appreciated that the structure and apparatus disclosed herein is merely one example of a means for releasable attachment, and it should be appreciated that any structure, apparatus or system for releasably attaching which performs functions the same as, or equivalent to, those disclosed herein are intended to fall within the scope of a means for attachment, including those structures, apparatus or systems for releasable attachment which are presently known, or which may become available in the future. Anything which functions the same as, or equivalently to, a means for releasable attachment falls within the scope of this element.

It will be appreciated that the position of the installed banner 14 on the windshield 12, as shown in FIG. 1 allows for a clear view along the entire width of the windshield 12. This allows the automobile to be safely test driven by a potential purchaser, with the banner 14 in place. This provides an advantage to the automobile seller, as time is not lost in removing the information, the vehicle is safe to operate, and during the test drive the information contained on the banner 14 is exposed to other potential purchasers, who may see the vehicle.

Figure 3:
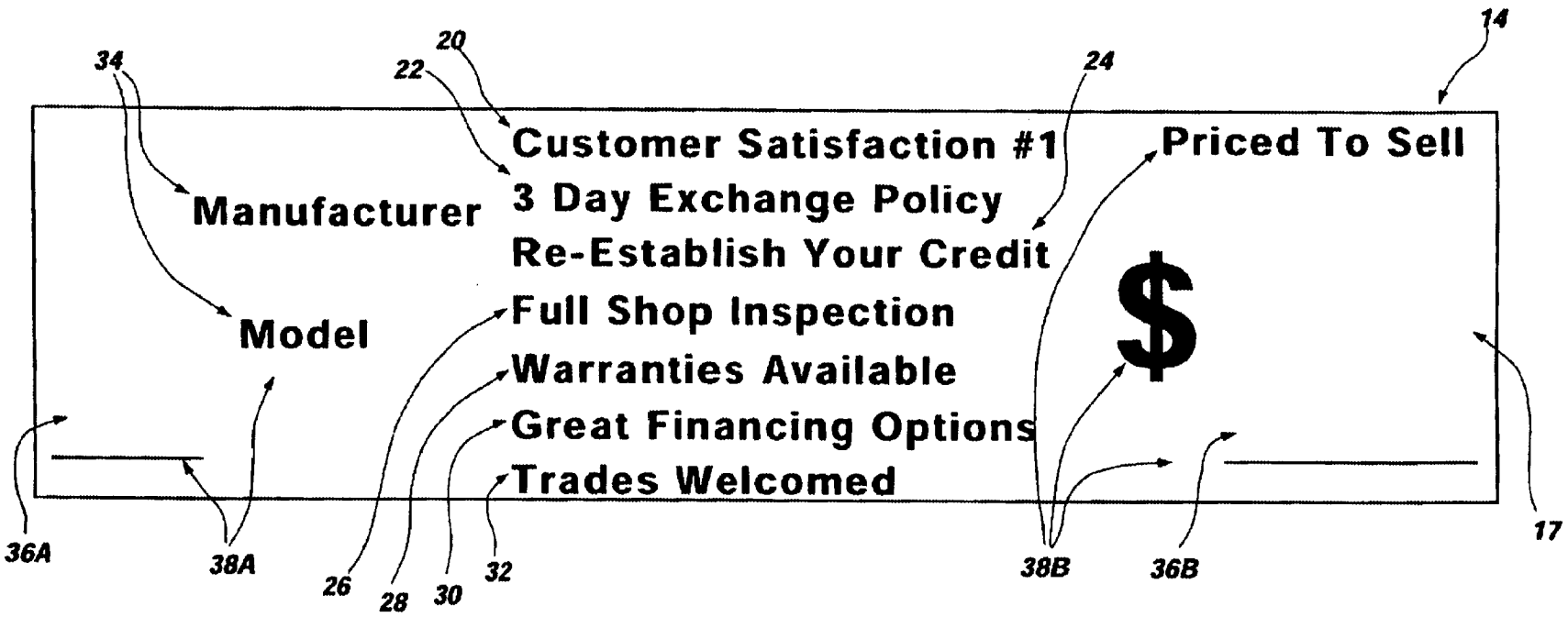
FIG. 3 is a front view of an automobile banner made in accordance with the principles of the present invention.

The banner 14 further includes a display body 17 that includes disclosure information disposed thereon such information being shown most clearly in FIG. 3. In the embodiment of FIG. 1, the display body 17 includes the front surface 16 of the banner 14, and has disclosure information disposed thereon. This feature will be further discussed below, in connection with FIG. 3. It will be appreciated that the front surface 16 of the banner 14 may have any conformation, or texture, but that it is preferably flat and more preferably has a smooth texture. While the banner 14 may be any color, the display body 17, or the banner 14 may be a bright color, if desired, to attract the attention of a potential purchaser. More preferably, the display body 17 comprises a color contrasting to the color of the automobile. The information may also be printed in bright colors. The concept of "bright colors" includes any color that is capable of attracting more attention than a conventional brown or black.

Figure 2:
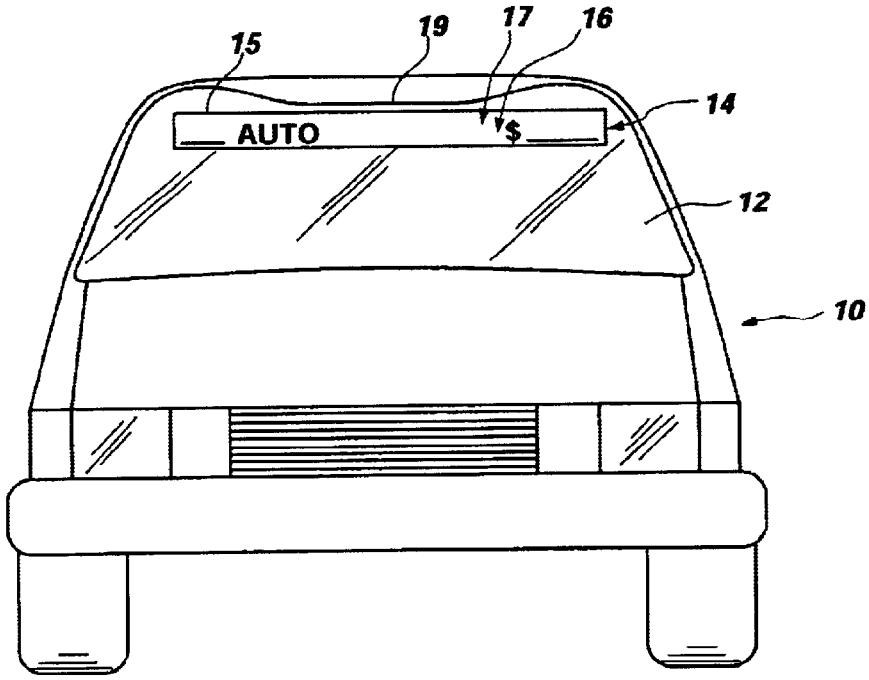
FIG. 2 is a second front view of an automobile banner made in accordance with the present invention, installed on a second automobile windshield.

Referring now to FIG. 2, the embodiment of FIG. 1 is shown installed on the windshield 12 of a different automobile 10. Differing from FIG. 1, the windshield 12 of FIG. 2 has a curved shape, and thus has a greater height at the sides of the windshield than at the midpoint. When the banner 14 is installed in a lateral position, as shown, the distance between the top edge 19 of the windshield 12 and the first edge 15 of the banner 14 is greater at the ends of the banner 14 than at the midpoint. A preferred position for the installation of the banner 14 is with a midpoint of the top edge 15 residing in a range between about 0.5 inches to about 6 inches below the top edge of the automobile windshield, and the corners residing at a distance in a range of about range of about 0.5 inches to about 6 inches below the top of the automobile windshield. A more preferred position is with the midpoint of the top edge 15 residing by a distance in a range of from about 1 inch to about 3 inches, and the corners residing at a distance within the range of from about 0.5 to 8 inches below the top edge of the automobile windshield. It will be appreciated that the advantages discussed in connection with FIG. 1 are also present here.

FIG. 3 shows a front view of another embodiment of an automobile banner 14 made in accordance with the principles of the present invention. As discussed above, there are many different pieces of information that need to be disclosed to potential purchasers of an automobile. FIG. 3 discloses an automobile banner 14, made in accordance with the principles of the present invention that accomplishes disclosure of some of these elements. The elements are disclosed by being disposed on the display body 17 of the banner 14. Disclosure information may be printed on the display body 17, integrally formed on the display body 17, or placed on the banner by any other suitable means. Disclosure information may be required legal information, that is required to be furnished to potential purchasers by state or federal law. It may also be the manufacturer, or model of the automobile, as indicated at numeral 34 of FIG. 3.

Disclosure information may further comprise, information that is required to be disclosed to potential purchasers by the automobile seller's arrangement with the manufacturer, or that is desired by the potential purchasers. This may include information relating to customer satisfaction, as shown in FIG. 3 by numeral 20, one of many possible ways of disclosing that customer satisfaction is a top priority of the seller of the automobile. It may include information relating to exchange policies, such as an indication of the availability or terms of an exchange policy, one possible example of which is shown at numeral 22 of FIG. 3. Possible disclosure information further includes information relating to credit availability, one possible example of which is shown as numeral 24 of FIG. 3, indicating that credit is available, other possibilities include the disclosure of at least part of the terms of available credit. The disclosure information may further include information concerning the availability of the automobile for inspection, part of the terms of an inspection policy or that the automobile was inspected pursuant to an established policy of the seller. An example of such information concerning inspection availability is shown at numeral 26 of FIG. 3. In formation concerning the availability of warranties, including possible warranty terms, conditions, or options may also be included as disclosure information, such as the indication that warranties are available at 28 in FIG. 3. Another possible type of disclosure information may be information concerning financing options, such as the indication that financing is available, shown at 30 of FIG. 3, or part of the terms, conditions or options under which financing is offered by the automobile seller. Disclosure information may also include information concerning trade-in availability, such as the indication that trade-in policies are available shown as numeral 32 of FIG. 3, or as an indication of the terms and conditions of trade-in policies.

It will be appreciated that the examples of disclosure information disclosed herein are merely a few examples of the possible types of disclosure information that may be disposed on the display body 17 of the automobile banner 14, and it should be appreciated that any information relating to the sale of the automobile, or the terms and policies of the automobile seller, that performs functions the same as, or equivalent to, those disclosed herein are intended to fall within the scope of disclosure information, including potential information that is presently known, or which may become available in the future. All such information falls within the scope of this element.

FIG. 3 further illustrates indicating means 38A and 38B disposed on the display body 17 indicating an area of free space 36A and 36B on said display body 17 on which additional information is to be placed. Since some of the information that potential purchasers of an automobile desire to know is specific to each automobile, a preferred embodiment of the present invention includes at least one area of free space on which additional information is to be placed. These areas are characterized by indicating means and an area free to receive additional information. Make and Model items 34, preceded by Free space, may also operate as an indicating means, particularly when the free space 36A resides above a blank line 38A. A symbol, such as dollar sign 38B, followed by free space, may also operate collectively as an indicating means. Thus, the indicating means can be preexisting information disposed on the display body 17. This preexisting information may comprise a noun, or verb that may be modified by the placement of additional information, an example of this is the manufacturer or model of the car, as shown at 38A of FIG. 3, which is modified by the additional information of the model year of the car. Another possibility is for the preexisting information to comprise a line, box, or other symbol that creates an area to be filled in with the additional information, examples of which are shown at 38A and 38B of FIG. 3. Preexisting information may further include a combination of these elements. It will be appreciated that the examples of preexisting information disclosed herein are merely a few of the many possible examples of preexisting information that are possible, and all such preexisting information is included within the scope of the present invention.

Another possible indicating means is an area of indicia-free space 36 on the display body 17, or banner 14. Preferably such an indicia free area on the display body 17, is characterized by a lateral length of at least 4 inches, and a vertical length of at least 1.5 inches, although other size areas fall within the scope of the present invention. More preferably, the indicating means comprises a combination of preexisting information and an indicia-free area.

In one possible embodiment, the area of free space 36A or 36B may be continuous with the remainder of the front surface and have the same texture as the front surface 16. In another embodiment, the area of free space 36A or 36B may be continuous with the front surface 16, but have a texture with a higher coefficient of friction (a "rougher surface") to facilitate the placement of additional information thereon. Alternatively, the area of free space 36 may be accessible on the rear surface 18 of the banner 14. It will be appreciated that all such variations are within the scope of the present invention.

Additional information may be placed on the area of free space. The additional information may include the asking price of the automobile, the model year of the automobile, or any other information that is desired to be disclosed to the potential purchasers. The additional information may be placed on the display body 17, or the surface of the banner 14 (if from the display body 17) by any suitable means, including printing information directly onto the banner, or writing the information on the banner 14 by hand. Any suitable ink, paint, or other marking means may be used. Preferably water based erasable markers, erasable ink pens, dry erase markers, grease pens, markers, pencils, or other erasable means are used, to facilitate the ability of the banner to be used a number of times.

Figure 4:
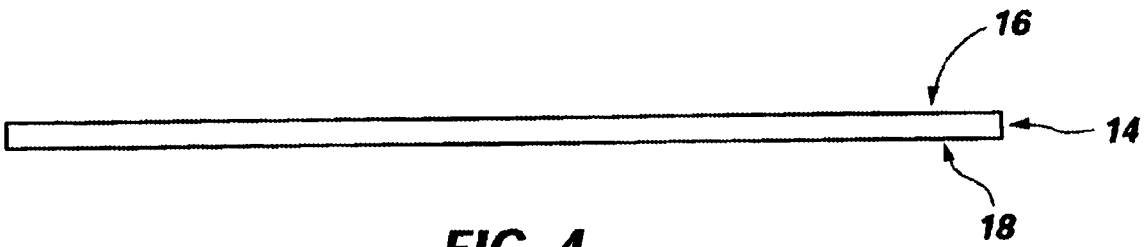
FIG. 4 is a side view of one embodiment of an automobile banner made in accordance with the principles of the present invention.

Reference will now be made to FIG. 4. FIG. 4 is a side view of one embodiment of an automobile banner 14 made in accordance with the present invention. The banner has a front surface 16 and a rear surface 18. As described above, the rear surface 18 includes attachment means for releasably attaching the banner 14 to an automobile windshield. The attachment means can be any suitable method, structure, or compound that may be used to releasably and repositionally attach the banner 14 to the windshield. Examples of such means include repositional adhesives, the application of pressure to the banner which causes an adhesive interaction between the banner and the windshield, or a static cling attraction between the glass surface of the windshield, and the rear surface 18, among other suitable means.

In the embodiment represented in FIG. 4, the banner 14 is constructed of a single layer of flexible material. The material can be any flexible material suitable for the purpose, including plastics, paper, and vinyl. One advantage of using vinyl, and other suitable materials, is that the means for attachment may be provided by the attraction between the glass windshield and the banner 14.

Figure 5:
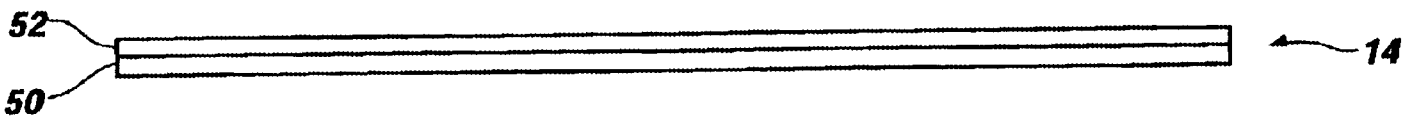
FIG. 5 is a side view of an alternative embodiment of an automobile banner made in accordance with the principles of the present invention.

Turning to FIG. 5, an alternative embodiment of an automobile banner 14 is shown. The FIG. 5 banner 14 is constructed of multiple layers of material, there is a top layer 52 and a bottom layer 50. The top layer includes the front surface 16, and the bottom layer includes the rear surface 18. The display body 17 may be located on the front surface 16, or on the bottom layer, and be visible through the top layer. Other possible embodiments in accordance with the present invention may have a plurality of layers, including a display body 17 that is visible through a top layer 52, or is located on a top, bottom or intermediate layer. The layers can be joined in any suitable fashion, including, being integrally formed, joined by an adhesive, or joined by the application of pressure and heat.

In accordance with the features and combinations described above, a preferred method of attaching a repositional advertising banner to an automobile includes the steps of:

(a) obtaining a repositional automobile advertising banner, the banner comprising
a display body;
attachment means for releasably attaching the banner to an automobile windshield, the windshield having a height and a width, such that the banner may be repositioned;
wherein the display body is sufficiently large such that said display body spans a majority of the width of the windshield when placed in a lateral position upon said windshield;

(b) attaching the banner to the exterior surface of an automotive windshield, comprising attaching the banner in a laterally extending position at an upper section of the automobile windshield.

The method may further include the step of applying a repositional adhesive to the banner, prior to attachment.

In accordance with the features and combinations described above, a preferred method of attaching a multiple use advertising banner to an automobile includes the steps of:

(a) obtaining a multiple use automobile advertising banner, the banner comprising
a display body;
a rear surface, comprising a means for releasably attaching the banner to an automobile windshield, the windshield having a height and a width, such that the banner may be reused a plurality of times;
wherein the display body is sufficiently large such that said display body spans a majority length of the width of the windshield when placed in a lateral position upon said windshield;

(b) attaching the banner to the exterior surface of an automotive windshield, comprising attaching the banner in a laterally extending position at an upper section of the automobile windshield.

The method may further include the step of applying a repositional adhesive to the banner, prior to attachment. The method may also further include the steps of removing and reusing the banner.

In accordance with the features and combinations described above, a preferred method of disclosing information concerning an automobile includes the steps of:

(a) obtaining a repositionable and reusable advertising banner, the banner comprising
a display body having disclosure information disposed thereon;
attachment means for releasably attaching the display body to an automobile windshield, the windshield having a height and a width, such that the display may be removed to be repositioned, and may be reused a plurality of times;
wherein the display body is sufficiently large such that said display body spans a majority length of the width of the windshield when placed in a lateral position upon said windshield;

(b) releasably attaching the banner in a laterally extending position to the exterior surface of an automotive windshield.

The method may further include the step of applying a repositional adhesive to the banner, prior to attachment to the windshield, and may include the removal and reuse of the banner.

In accordance with the features and combinations described above, another preferred method of disclosing information concerning an automobile includes the steps of:

(a) obtaining a repositionable and reusable advertising banner, the banner comprising
a display body;
attachment means for releasably attaching the display body to an automobile windshield, the windshield having a height and a width, such that the display body may be removed to be repositioned, and may be reused a plurality of times;
indicating means disposed on the display body for indicating an area of free space on said display body on which additional information is to be placed;
wherein the display body is sufficiently large such that said display body spans a majority length of the width of the windshield when placed in a lateral position upon said windshield;

(b) releasably attaching the banner to the exterior surface of an automotive windshield; and (c) placing disclosure information on the display body of the automobile banner, either prior to attachment or after attachment to the windshield.

The disclosure information may be placed on the banner by writing or printing, as described above. The method may further include the step of applying a repositional adhesive to the banner, prior to attachment to the windshield, and may include the removal and reuse of the banner.

In accordance with the features and combinations described above, a preferred method of selling an automobile includes the steps of:

(a) obtaining a automobile advertising banner, the banner comprising
a display body having disclosure information disposed thereon;

a rear surface, comprising a means for releasably attaching the banner to an automobile windshield, the windshield having a height and a width;

wherein the display body is sufficiently large such that said display body spans a majority length of the width of the windshield when placed in a lateral position upon said windshield;

(b) attaching the banner to the exterior surface of an automotive windshield, comprising attaching the banner in a laterally extending position at an upper section of the automobile windshield, such that a view of the full width of the windshield remains unencumbered;

(c) conducting a test drive of the automobile by a potential purchaser with the banner in said laterally extending position.

The method may further include the step of applying a repositional adhesive to the banner, prior to attachment to the windshield, and may include the removal and reuse of the banner.

It will be appreciated that the above described apparatus and methods concerning an automobile advertising banner that is repositional and reusable, is configured to be placed at the top of the exterior surface of an automobile windshield and allows for at least some of the information on the banner to be altered, fulfills the objects outlined above. Further the apparatus and methods allow for the disclosure of information concerning an automobile, on the automobile windshield while allowing the car to be safely operated without a need for the removal of the information, or for the information to be limited.

It is to be understood that the concept of a "multiple use" banner, and the concept of a "repositionable" or "repositional" banner, as used herein, are separate and different concepts. A "multiple use" banner refers to a banner than contains pre-placed information that is common to a plurality of different makes and models of automobiles and which can therefore be apply to and be placed upon any of a number of different automobiles, or to a banner that is physically durable enough to be removed and placed on another automobile a plurality of times without tearing or failing in some way, and by any necessary re-application of adhesive. In contrast, a "repositional" banner refers to a banner that can be removed and replaced, either upon the same automobile or upon a different automobile, a number of times without the need for a re-application of adhesive.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of promoting the sale of an automobile comprising:

(a) obtaining an automobile advertising banner, the banner comprising a display body for placing disclosure information thereon;

(b) providing as part of said banner an offer of customer satisfaction as a top priority of a seller of the automobile, in written form on said banner;

(c) providing as part of said banner an offer of credit available to potential purchasers of a motor vehicle, in written form on said banner;

(d) providing as part of said banner an offer of at least part of some terms under which an inspection of a motor vehicle is available, in written form on said banner;

(e) providing as part of said banner an offer of warranties available relating to the repair of a motor vehicle, in written form on said banner;

(f) providing as part of said banner an offer of financing options available to assist a purchase of a motor vehicle, in written form on said banner;

(g) providing as part of said banner an offer of trade-in policies available relating to a purchase of a motor vehicle, in written form on said banner;

(h) providing a bright color on a front surface of said display body;

(i) placing indicating means on the display body for indicating an area of free space on said display body on which additional information may be placed;

(j) providing the indicating means as a preexisting symbol disposed on the display body and said area of free space as an indicia-free area disposed on the display body adjacent to said symbol, said indicia-free area having a lateral length of at least 4 inches, and a vertical length of at least 1.5 inches;

(k) providing a rear surface on said display body, said rear surface comprising an attachment means for releasably attaching the banner to an automobile windshield, the attachment means comprising a repositionable adhesive disposed on the rear surface of the display body;

(l) providing the display body with at least a first edge, and a second edge opposite the first edge, a third edge and a fourth edged opposite the third edge;

(m) providing the display body with a rectangular shape, with a long axis parallel to the first edge and opposite second edge, and a short axis parallel to the third and opposite fourth edge, said long axis having a length within a range of about 40 inches to about 60 inches, and said short axis having a length within a range of about 4 inches to about 6 inches;

(n) attaching the banner to the exterior surface of an automotive windshield, comprising attaching the banner in a laterally extending position at an upper section of the automobile windshield, such that a view of the full width of the windshield remains unencumbered;

(o) positioning the display body on the exterior surface of the windshield, such that the display body is in a lateral position such that a midpoint of the first edge resides below a top edge of the automobile windshield by a distance within a range of from about 1 inch to about 3 inches, and a point where a first corner, located at the interface between the first edge and the third edge is located from about 1.5 inches to about 5 inches from the top edge of the automobile windshield;

(p) applying pressure to the display body to cause the adhesive to hold the display body to the exterior surface of the windshield;

(q) placing additional information on the display body of the automobile banner, either prior to attachment or after attachment to the windshield, said additional information relating to transaction elements of a potential sale of a motor vehicle, wherein the additional information is placed in the area of free space, and wherein the additional information comprises a model year of the automobile, and an asking price of the automobile, and wherein the step of placing additional information on the display body further comprises writing the disclosure information by hand with an erasable writing utensil;

(r) conducting a test drive of the automobile by a potential purchaser with the banner attached to the exterior surface of the automobile windshield in said laterally extending position; and (s) erasing the additional information from the area of free space and placing different additional information on the area of free space pertaining to the sale of a different vehicle such that the advertising banner is used in the sale of multiple vehicles.

2. The method of claim 1, further comprising providing said area of free, space with a uniformly smooth texture continuous with the front surface, and a higher coefficient of friction on the area of free space than a remainder of the front surface.

3. The method of claim 1, further comprising providing said automobile advertising banner as at least two layers joined together, one of said layers being the display body.

4. The method of claim 3, further comprising laminating the at least two layers to one another.

5. The method of claim 3, further comprising joining the at least two layers with an adhesive.

6. The method of claim 1, further comprising constructing said automobile banner of a single plastic layer.

* * * * *